United States Patent [19]

Kanda et al.

[11] Patent Number: 4,505,233

[45] Date of Patent: Mar. 19, 1985

[54] PISTON ASSEMBLY WITH COOLING LUBRICANT RESERVOIR DEFINING MEMBER WITH A DEEP NARROW RESERVOIR AND A SHALLOW WIDE RESERVOIR

[75] Inventors: Mutsumi Kanda; Souichi Matsushita; Kiyoshi Nakanishi; Tokuta Inoue, all of Toyota, Japan

[73] Assignee: Toyota Jidosha Kabushiki Kaisha, Toyota, Japan

[21] Appl. No.: 623,933

[22] Filed: Jun. 25, 1984

[30] Foreign Application Priority Data

Jan. 24, 1984 [JP] Japan ..... 59-010678

[51] Int. Cl.[3] ..... F01P 3/10; F02F 3/20

[52] U.S. Cl. ..... 123/41.35; 92/159; 92/186; 123/193 P

[58] Field of Search ..... 123/41.35, 41.39, 193 P; 92/158, 159, 186, 208, 216

[56] References Cited

U.S. PATENT DOCUMENTS 1,321,525 11/1919 Hellweg ..... 92/186
2,051,547 8/1936 Crist ..... 92/216
2,416,429 2/1947 Boucher ..... 92/158
3,805,677 4/1974 Clary et al. ..... 92/216

FOREIGN PATENT DOCUMENTS 58-70038 4/1983 Japan ..... 123/193 P

*Primary Examiner*—William A. Cuchlinski, Jr.
*Attorney, Agent, or Firm*—Kenyon & Kenyon

[57] ABSTRACT

A piston assembly for an internal combustion engine is made up from a piston main body and a lubricant reservoir defining member. The piston main body has a cup shaped structure including a crown portion and a hollow cylindrical wall portion joining thereto. The lubricant reservoir defining member includes a shelf plate main body portion formed with first and second depressions which define first and second lubricant reservoirs, and is securely mounted within the cup shaped piston structure with the shelf plate portion generally to and opposing the piston crown. The ratio of the surface area of the first lubricant reservoir to the surface area of the second lubricant reservoir is less than the ratio of the volume of the first lubricant reservoir to the volume of the second lubricant reservoir. Lubricant is supplied more towards the first lubricant reservoir and is drained more from the second reservoir.

7 Claims, 5 Drawing Figures

PISTON ASSEMBLY WITH COOLING LUBRICANT RESERVOIR DEFINING MEMBER WITH A DEEP NARROW RESERVOIR AND A SHALLOW WIDE RESERVOIR

BACKGROUND OF THE INVENTION

The present invention relates to a piston assembly for an internal combustion engine, and, more particularly, relates to a piston assembly for an internal combustion engine which incorporates an oil cooling system for cooling the piston during operation of the engine.

A piston assembly for an internal combustion engine generally becomes very hot during use, and is subjected to relatively severe thermal stresses as compared to other engine parts, especially on its top wall or crown portion which is directly exposed to the heat of the gases in the combustion chamber partly defined by the piston. This problem of heating of the crown of the piston assembly has become more and more severe with modern internal combustion engines, due to increases in thermal load on the parts thereof arising from increases in engine power output. Various schemes have been developed in the past for aiding with the cooling of such a piston assembly; and nowadays some form of active cooling for the piston assembly is coming to be quite necessary.

In particular, the concept of cooling the piston crown from below by injecting a flow of engine lubricant from the crank chamber side up into the cup shaped space defined by the piston crown and the piston skirt, so as to impinge against the lower side of the piston crown and to cool it, has been put forward in the past in various forms: for examle, such piston cooling constructions have been proposed in Japanese Utility Model Application No. 38-11185 (Publication No. 40-19201), Japanese Utility Model Application No. 42-101852 (Publication No. 45-32981), Japanese Utility Model Application No. 49-96796 (Publication No. 54-26424), Japanese Utility Model Application No. 55-42967 (Laying Open Publication No. 57-156052), Japanese Patent Application No. 58-138183, Japanese Utility Model Application No. 58-164040, and Japanese Utility Model Application No. 58-188456. And, in particular, it has been recognized that it is helpful for such lubricant cooling of the piston crown to provide a member near the lower surface of said piston crown which defines a reservoir for temporarily and intermittently accumulating a pool of lubricant therein, so that lubricant from this pool can be splashed against the piston crown as the piston reciprocates in the cylinder bore.

Such a lubricant reservoir may be defined by a part of the piston assembly which is integrally formed or cast with the piston main body itself, or is welded thereto; but this presents difficulties such as increasing difficulty and cost of manufacture and introducing quality problems during manufacture. Because of this, in the above identified applications, there has been proposed the concept of providing this lubricant reservoir as defined by a shelf plate member fixed in the space within the piston main body near the piston crown. These lubricant reservoirs are intended to provide a good supply of relatively cool lubricant to the lower surface of the piston crown; but the prior art such shelf plate members have not yet been completely perfectly satisfactory in this respect, because the circulation of cool lubricant has not been as good as could be wished. There still remains a problem in that some lubricant is again and again repeatedly splashed against the piston crown from the lubricant reservoir, without being recirculated to the lubricant sump of the engine and being replaced by fresh lubricant therefrom. Since, after any particular mass of lubricant has once been splashed against the piston crown for cooling it, said lubricant is naturally heated up, the subsequent splashings of this lubricant against the piston crown are less effective for providing cooling thereto, thus causing cooling inefficiency. Yet, it is not practicable to provide any moving parts to the piston assembly or the lubricant reservoir thereof, and the construction is absolutely required to be simple and strong and reliable, in view of the vibration and accelerative forces to which it is subject during operation of the engine.

SUMMARY OF THE INVENTION

Accordingly, it is the primary object of the present invention to provide a piston assembly, which can be well and effectively cooled by lubricant supply to the internal space within it.

It is a further object of the present invention to provide such a piston assembly, which has a shelf plate member of the type described above, wherein the cooling flow of lubricant across the bottom of the piston crown is enhanced.

It is a further object of the present invention to provide such a piston assembly which has a shelf plate member of the type described above for aiding with cooling lubricant flow, wherein the lubricant held in reserve on said shelf plate member for splashing against the bottom of the piston crown and cooling it changes steadily and periodically.

It is a further object of the present invention to provide such a piston assembly which has a shelf plate member of the type described above, wherein the cooling flow of lubricant across the bottom of the piston crown is caused to have a definite direction.

It is a yet further object of the present invention to provide such a piston assembly, which is durable and reliable during use.

It is a yet further object of the present invention to provide such a piston assembly, which is easy to manufacture.

It is a yet further object of the present invention to provide such a piston assembly, which does not cost a great deal to manufacture.

According to the most general aspect of the present invention, these and other objects are accomplished by for an internal combustion engine: a piston assembly, comprising: (a) a piston main body, comprising a piston crown portion and a generally hollow cylindrical piston wall portion joining thereto which together define a generally cup shaped structure; and (b) a lubricant reservoir defining member comprising a shelf plate portion and mounted within said cup shaped structure of said piston main body with said shelf plate portion generally parallel to and opposing said piston crown portion, so as to define a chamber space between said piston crown portion and said shelf plate portion; said shelf plate portion being formed with first and second depressions which define first and second lubricant reservoirs having first and second ends and first and second volumes, respectively, the ratio of the surface area of said first lubricant reservoir to the surface area of said second lubricant reservoir being less than the ratio of the volume of said first lubricant reservoir to the volume of said second lubricant reservoir; said chamber space being supplied with lubricant at a portion thereof adjacent to said first depression and open to drain lubricant therefrom at a portion thereof adjacent to said second depression.

According to such a structure, the lubricant reservoir defining member helps with the circulation of cooling lubricant for the piston crown portion in a fashion which will be explained in detail hereinafter. In brief, as lubricant is squirted upwards at the underneath of the piston during engine operation, as the piston goes over its top dead center the lubricant stored in the first and the second reservoirs is thrown against the piston crown portion and sticks thereagainst and cools it, while on the other hand as the piston goes past its bottom dead center the heated lubricant adhering against the piston crown portion falls off it and lands on the shelf plate portion and passes into said first and second reservoirs, in relative amounts basically proportional to the surface areas of said first and second reservoirs. Since the ratio of the surface area of the first lubricant reservoir to the surface area of the second lubricant reservoir is less than the ratio of the volume of the first lubricant reservoir to the volume of the second lubricant reservoir, the heated lubricant tends to overflow from the second reservoir to return to the engine sump. Therefore, when new lubricant is supplied principally towards the first reservoir, a good and steady flow of lubricant for cooling the piston crown portion is reliably achieved.

BRIEF DESCRIPTION OF THE DRAWINGS

The present invention will now be shown and described with reference to the preferred embodiments thereof, and with reference to the illustrative drawings. It should be clearly understood, however, that the description of the embodiments, and the drawings, are given purely for the purposes of explanation and exemplification only, and are none of them intended to be limitative of the scope of the present invention in any way, since the scope of the present invention is to be defined solely by the legitimate and proper scope of the appended claims. In the drawings, like parts and features are denoted by like reference symbols in the various figures thereof, and:

DESCRIPTION OF THE PREFERRED EMBODIMENTS

Figure 1:
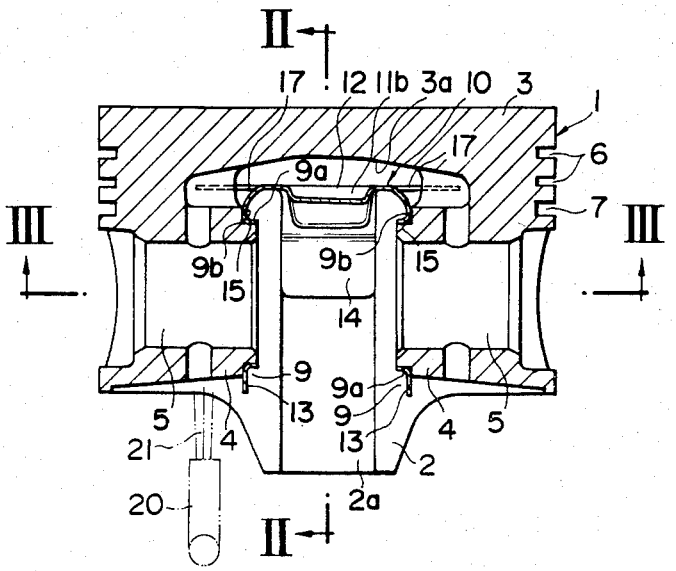
FIG. 1 is a longitudinal sectional view of a first preferred embodiment of the piston assembly for an internal combustion engine according to the present invention, taken in a plane which contains the central longitudinal axes of said piston assembly and of a piston pin fitting hole formed therein.
Figure 2:
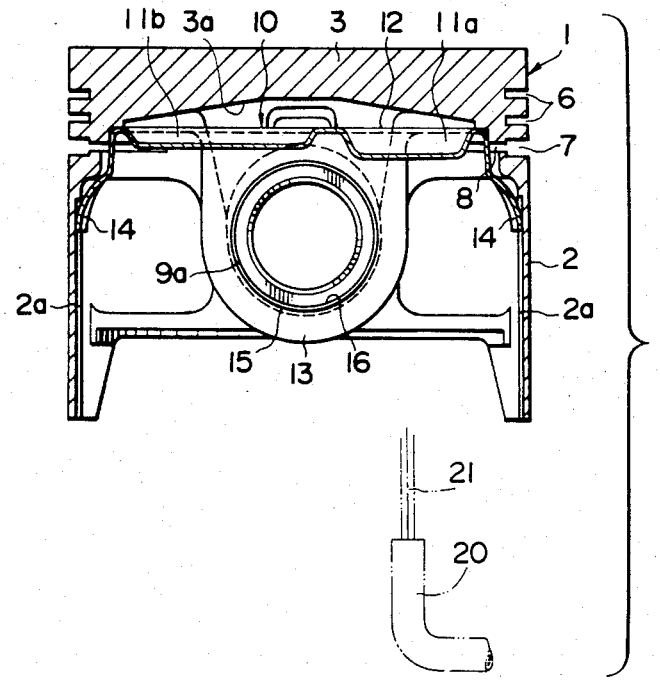
FIG. 2 is another longitudinal sectional view of said first preferred embodiment, taken in a plane shown by the arrows II—II in FIG. 1 and containing said central axis of said piston assembly while being perpendicular to said central axis of said piston pin fitting hole.

The present invention will now be described with reference to the preferred embodiments thereof; and with reference to the appended drawings. FIGS. 1 and 2 show the first preferred embodiment in longitudinal sectional views. The piston assembly according to this first preferred embodiment comprises a piston main body 1 and a lubricant reservoir defining member 10 mounted therein as will be explained shortly. This main body 1 is typically a cast member, and is made generally as a cup shaped body having: a cylindrical side wall or skirt portion 2, a top wall or crown portion 3, and two boss portions 4. The boss portions 4 are each pierced with a piston pin fitting hole 5, and are contiguous with the crown portion 3 and lie just therebelow as seen in FIGS. 1 and 2, confronting one another on opposite sides of the central axis of the piston assembly; and their inner ends protrude towards one another free of the rest of the piston assembly. The piston pin fitting holes 5 are mutually coaxial, and are adapted to receive a piston pin, not shown in the figures, for pivotably fitting the piston assembly to a connecting rod, also not shown.

The lower surface in FIGS. 1 and 2 of the crown portion 3, i.e. its surface remote from the combustion chamber (not shown) with which this piston assembly cooperates, which constitutes the ceiling surface 3*a* of the internal space within the piston assembly, is formed substantially as a shallow conical surface inclined in the upwards direction; alternatively, this lower surface may be formed as a concavely spherical surface. Circumferentially around the outer surface of the crown portion 3 there are incised two piston ring grooves 6 and an oil scraper ring groove 7, and, as shown in FIG. 2, the bottom of said scraper ring groove 7 is communicated to the internal space within the piston assembly by a plurality of slit holes 8.

Each of the free inwardly protruding end parts of the boss portions 4 is formed with a step shape 9, defined by a narrowed down cylindrical end portion 9*a* of the boss inner end part and by a flat annular surface 9*b* which extends outwards from the base of said end portion 9*a*. The inner surface of the skirt portion 2 of the piston assembly is formed with two longitudinally extending shallow and relatively wide grooves 2*a* which confront one another on opposite sides of the central axis of the piston assembly on a line perpendicular to the central axis of the piston pin fitting holes 5. These grooves 2*a* extend downwards to the lower edge of the skirt portion 2.

Figure 4:
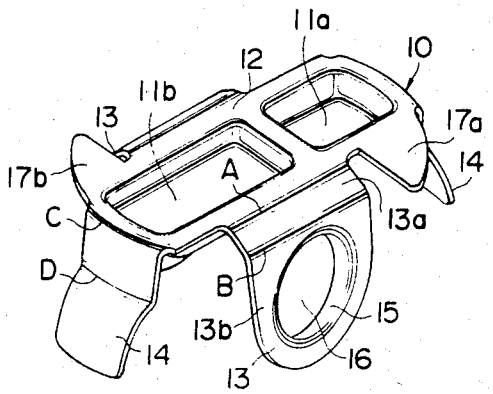
FIG. 4 is a perspective view of a lubricant reservoir defining member comprised in said first preferred embodiment shown in FIGS. 1 through 3, as seen in its unstressed state when not yet fitted to the piston assembly.

The lubricant reservoir defining member 10, shown in FIG. 4 in its free unstressed state in perspective view, is press formed as a whole of a piece of metallic plate of suitable thickness and elasticity, such as spring steel plate. The member 10 has a central shelf portion 12 formed generally as a rectangle with two lubricant receiving depressions 11*a* and 11*b* formed by drawing or a similar process in its interior. Two wider legs 13 are formed by bending downwards (from the point of view of FIG. 4) two protruding ears formed on the central portions of the longer sides of this rectangular central shelf portion 12; and similarly two narrower legs 14 are formed by bending downwards two protruding arms formed on the shorter sides of the shelf portion 12. The narrower legs 14 are of width and length adapted just to fit into the abovementioned grooves 2*a* in the piston skirt 2, and are in fact formed by bending the protruding arms downwards along first lines C close to the shelf portion 12 and then by bending them somewhat outwards along second lines D, so that their main bodies spread outwards somewhat in the free state, as clearly shown in FIG. 4; and the wider legs 13 are in fact formed by bending the protruding ears downwards somewhat along first lines A close to the shelf portion 12 and then by bending them further somewhat downwards along second lines B, so as to define relatively small intermediate leg portions 13*a* and relatively large end leg portions 13*b* which also spread outwards somewhat in the free state. The distance apart in the unstressed state of the free ends of the narrower legs 14 is slightly greater than the distance between the bottoms of the grooves 2*a*. And, relating to the wider legs 13, the distance apart of the bending lines A between the shelf portion 12 and the intermediate leg portions 13*a* is slightly less that the distance apart of the very end surfaces of the inwardly protruding end parts of the boss portions 4 so that the legs 13 can pass through between the very end surfaces when they are bent to approach to one another, while the distance apart of the bending lines B between the intermediate leg portions 13*a* and the end leg portions 13*b* is substantially equal to the distance apart of the aforementioned flat annular surfaces 9*b* formed on said inward end parts of the boss portions 4. Each of these end leg portions 13*b* is pierced with a circular hole 16 which is bordered with a cylindrical flange 15 whose inner diameter is just appropriate for said flange 15 to fit over one of the aforesaid narrowed down cylindrical end portions 9*a* of the bosses 4. And the lower edge of each of the end leg portions 13*b* is formed in a semicircular shape, and the diameter of these lower ends is greater than the outer diameters of said flat annular surfaces 9*b* on the inward parts of the boss portions 4. Finally, two side wing portions 17 are provided extending from opposite end parts of the two long sides of the central shelf portion 12 not occupied by the abutment of the wider legs 13, in its plane, as shown in FIG. 4.

This lubricant reservoir defining member 10 is assembled into the piston body 1 in the following manner, by utilizing its own spring action. First the member 10 is approached towards the under side of the piston body 1, with the shelf portion 12 towards said piston body 1 and parallel to the crown portion 3 and with the long sides of said shelf portion 12 parallel to the central axis of the piston pin fitting holes 5, and then the wider legs 13 of said member 10 are squeezed together somewhat (by hand or by a jig), so that their maximum distance apart is less than the minimum distance apart between the very end surfaces of the inwardly protruding end parts of the boss portions 4, with the legs 13 bending both along the line A and along the line B. Then the member 10 is inserted within the inner space of the piston body 1 in this condition, with the wider legs 13 aligned to the bosses 4 and fitting easily in between said bosses 4, and with the narrower legs 14 aligned to the grooves 2*a*. As this is done these narrower legs 14 engage slidingly into the grooves 2*a* and guide the insertion of the member 10 into said piston body 1. When the holes 16 in the wider legs 13 becomes aligned with the piston pin fitting holes 5 in the bosses 4, then the squeezing of these legs 13 is released, so that they spring apart under their own spring force so that the outer surfaces of the narrowed down cylindrical end portions 9*a* of the bosses 4 fit into the inner surfaces of the flanges 15 around the holes 13 and the end portions 9*a* enter into the holes 16 until the main body portions of the end leg portions 13*b* rest against the flat annular surfaces 9*b* defined on the inward parts of the boss portions 4.

Thus, the lubricant reservoir defining member 10 comes to be securely fitted to the piston main body 1 by its own spring action, with the flanges 15 fitting around the end portions 9*a* and with the legs 14 also fitting into the grooves 2*a*. At this time, the rotation of the member 10 around the central axis of the piston pin holes 5 is prevented by the fitting of the legs 14 into the grooves 2*a* under their own spring force; but in an alternative embodiment this action could be reinforced by forming the end portions 9*a* of the bosses 4 and the corresponding holes 16 in the leg portions 13 of the member 10 in non circular shapes. It will be understood from the above descriptions that the lubricant reservoir member 10 is easily, reliably, and effectively mountable to the piston main body 1, without the use of any special tools being required, and without any special mounting members being required, simply by the provision on the piston main body 1 of the stepped shapes 9 on the inner ends of the piston pin bosses 4, and of the grooves 2*a*. Thus the piston main body need not be substantially altered, as compared to the main body of a piston to which it is not planned to fit such a lubricant reservoir defining member. This construction for engaging the lubricant reservoir defining member 10 to the piston main body by the legs 13 thus fitting to the bosses 4 is the subject of a copending patent application, invented by the same inventors as the present application and assigned to the same assignee.

Figure 3:
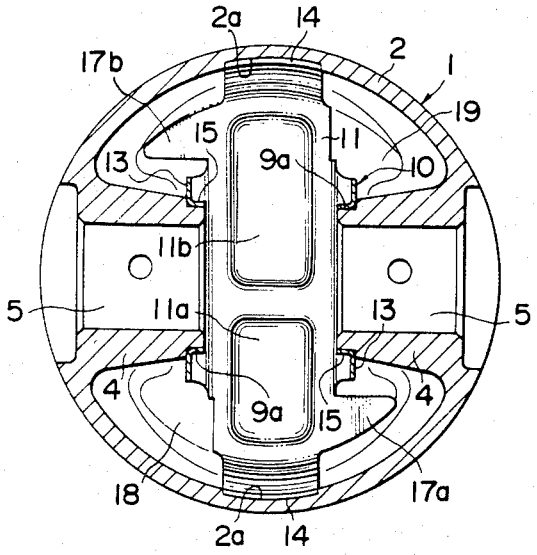
FIG. 3 is a transverse sectional view of said first preferred embodiment, taken in a plane shown by the arrows III—III in FIG. 1 and perpendicular to said central axis of said piston assembly while containing the central axis of said piston pin fitting hole.

When the lubricant reservoir defining member 10 is thus fitted to the piston main body 1, the shelf plate portion 12 extends along a plane which is perpendicular to the central axis of the piston assembly (and which is arranged to be substantially horizontal when the piston assembly is fitted to its internal combustion engine). At this time, two reservoirs suitable for receiving pools of engine lubricant are defined near the lower surface 3*a* of the piston crown portion 3 by the depressions 11*a* and 11*b*. As can be seen in FIG. 3 which is a view from underneath (with respect to FIGS. 1 and 2) of the assembly, at one longitudinal end (the lower end in the figure) of the rectangular shelf plate 12 on one side thereof (the left side in the figure) there is defined a relatively large opening 18 between the side wall 2 of the piston main body 1 and the edge of the shelf plate 12, opening between the space below the plate 12 and the space above said plate 12 between it and the piston crown 3; while at the other longitudinal end (the upper end) and on the other side (the right side) of said rectangular shelf plate 12 there is also similarly defined a relatively large opening 19 between the side wall 2 of the piston main body 1 and the edge of the shelf plate 1, again opening between said spaces below and above the plate 12. Other openings between said spaces are effectively blocked by the shelf plate 12 and/or by the wing portions 17 protruding from the sides thereof. The one 18 of these openings functions as a passage for supplying lubricant to the lubricant receiving depressions 11*a* and 11*b*, as will be explained shortly, while the other one 19 of the openings functions as a passage for ejection of lubricant therefrom.

According to the general inventive concept of the present invention, the ratio of the surface area $S_1$ of the first lubricant reservoir 11*a* to the surface area $S_2$ of the second lubricant reservoir 11*b* is made to be less than the ratio of the volume $V_1$ of the first lubricant reservoir 11*a* to the volume $V_2$ of the second lubricant reservoir 11*b*. As a certain specializations thereof, in this first preferred embodiment, the surface area $S_1$ of the first lubricant reservoir 11*a* is smaller than the surface area $S_2$ of the second lubricant reservoir 11*b*, the depth of the first lubricant reservoir 11*a* is greater than the depth of the second lubricant reservoir 11*b* and thus the ratio of the surface area of the first lubricant reservoir 11*a* to the surface area of the second lubricant reservoir 11*b*, $S_1/S_2$, is less than the ratio of the volume of the first lubricant reservoir 11*a* to the volume of the second lubricant reservoir 11*b*, $V_1/V_2$. (In this particular embodiment, $V_1/V_2$ is substantially 1). In this connection, in this particular embodiment, the central point of the shallow concave conical shape of the surface 3*a* of the piston crown portion 3 is opposed to the second lubricant reservoir 11*b*; in fact, this second reservoir 11*b* extends over a larger area to oppose to the piston crown under surface 3*a* than the first reservoir 11*a*.

Now the cooling of this piston assembly by the flow of engine lubricant, during operation of the internal combustion engine to which it is fitted, will be explained.

As the piston assembly reciprocates up and down (in the sense of FIGS. 1 and 2) in its cylinder bore (not shown) at high speed, a jet 21 of engine lubricant is squirted upwards at it from a nozzle 20 which is secured to some fixed engine part, not shown, such as the crankcase. This jet 21 is so aimed as to pass largely through the opening 18 between the side wall 2 of the piston main body 1 and the edge of the shelf plate 12, so as largely to pass into the space above said shelf plate 12 between it and the piston crown 3 and to hit against the ceiling surface 3*a* of said piston crown 3. Now, when the piston assembly is moving upwards in FIGS. 1 and 2 away from the nozzle 20, i.e. on its compression or its exhaust stroke, then the speed of the lubricant jet 21 relative to the piston crown 3 is not so very great, so that this jet 21 does not hit the crown ceiling surface 3*a* very hard and most of the lubricant in the jet 21 falls down against the upper side of the shelf plate 12, so as to be accumulated in the lubricant receiving depressions 11*a* and 11*b*. As the piston assembly goes over top dead center and starts downwards on its power or intake stroke, then due to its sudden reversal of direction of motion this lubricant in the depressions 11*a* and 11*b* is hurled upwards out of them by the action of its inertia and is thrown against the piston crown ceiling surface 3*a* en masse, all over the ceiling surface 3*a*. Since the ceiling surface 3*a* is, as explained above, shaped as a concave cone (or alternatively in a concave spherical shape) this causes the lubricant attached onto the ceiling surface 3*a* to flow towards the central portion of said ceiling surface 3*a* so as to apply better cooling action to the piston crown 3. Meanwhile, during this downward stroke of the piston assembly, also the jet flow 21 of lubricant from the nozzle 20 continues to pass through the opening 18, and, since now the speed of the lubricant jet 21 relative to the piston crown 3 is great, now this jet 21 hits the crown ceiling surface 3*a* quite hard at a point substantially directly above the opening 18. The lubricant from the jet 21 then flows along the ceiling surface 3*a* away from its impact point and towards the central part of the surface 3*a*, and then past the central part towards the part of the ceiling surface 3*a* which opposes the other opening 19 which is substantially diametrically opposite the opening 18. This flow of lubricant from the jet 21 entrains the lubricant splashed up as explained above from the lubricant reservoirs 11*a* and 11*b* and drags it along with it towards said part of the ceiling surface 3*a* which opposes the opening 19, as a result replacing the lubricant which has absorbed heat from the piston crown 3 with new cool lubricant for further cooling. When the piston assembly approaches its bottom dead center and starts to be accelerated in the upwards direction in the figures, then this lubricant accumulated opposite the opening 19 becomes detached from the piston crown surface 3*a*, again by the action of its inertia, and falls downwards, largely passing through the opening 19. Of course, quite a lot of this lubricant impinges against the shelf plate 12 and becomes again collected in the reservoirs 11*a* and 11*b* therein, to go again through the cycle described above; but since the ratio of the surface area of the first lubricant reservoir 11*a* to the surface area of the second lubricant reservoir 11*b*, $S_1/S_2$, is less than the ratio of the volume of the first lubricant reservoir 11*a* to the volume of the second lubricant reservoir 11*b*, $V_1/V_2$, more amount of lubricant overflows from the second lubricant reservoir 11*b* than from the first lubricant reservoir 11*a*, so that the spill over of lubricant from the lubricant reservoir provided by the lubricant reservoir defining member 10 occurs principally at a side thereof opposite to its side where lubricant is constantly supplied from the nozzle 20, thereby expediting recirculation of lubricant through the inside of the piston. Thus, by the actions explained above, there is ensured a substantial and steady net flow of lubricant in the space between the member 10 and the piston crown 3 across the piston crown surface 3*a* from the general area thereof opposed to the opening 18 and the first lubricant reservoir 11*a* to the general area thereof opposed to the opening 19 and the second lubricant reservoir 11*b*, and generally the flow of lubricant is through the opening 18 from the jet 21, across the piston crown surface while perhaps once or repeatedly entering the pools of lubricant in the reservoirs 11*a* and 11*b*, and then out through the opening 19. Also, of course quite a lot of this lubricant detached from the crown surface 3*a* falls down onto the tops of the piston pin bosses 4, and flows around these bosses to their lower surfaces.

In the shown first preferred embodiment, because in particular the surface area $S_1$ of the first lubricant reservoir 11*a* is smaller than the surface area $S_2$ of the second lubricant reservoir 11*b*, therefore the tendency for the heated lubricant to fall more into the second lubricant reservoir 11*b* is even more accentuated, and accordingly the flow of lubricant from the opening 18 to the opening 19 is even more favorably promoted. Further, since the ceiling surface 3*a* of the piston croown 3 is, as explained above, shaped as a shallow concave cone, so that the heated lubricant flows towards the central portion of said ceiling surface 3*a* so as to accumulate in a central pool thereon, and since in this first preferred embodiment particularly the central point of the conical shape of the surface 3*a* is opposed to a point of the second lubricant reservoir 11*b*, therefore when this central pool of heated lubricant is thrown off the piston crown ceiling surface 3*a* onto the lubricant reservoir defining member 10 most of it tends to fall into the second lubricant reservoir 11*b*, thus again increasing the tendency for the heated lubricant to fall into this second reservoir 11*b* and to thus flow in the fashion explained above.

Figure 5:
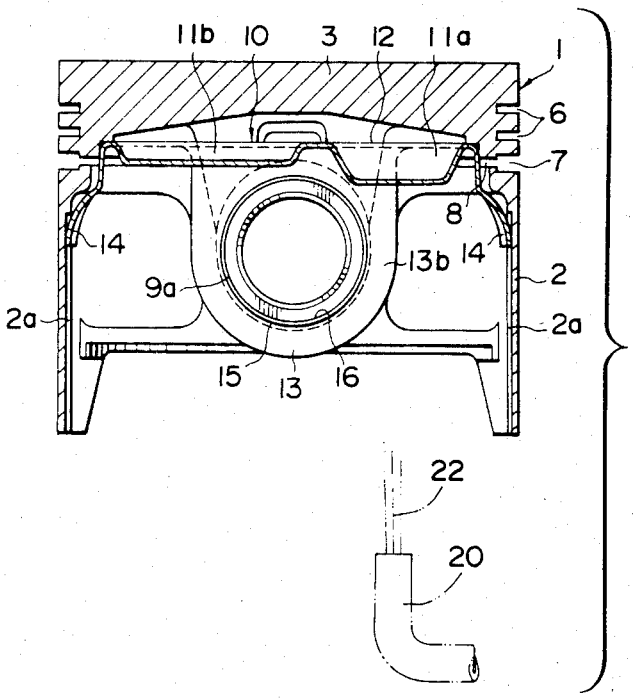
FIG. 5 is a longitudinal sectional view, similar to FIG. 2, of a second preferred embodiment of the piston assembly according to the present invention, taken in a plane corresponding to the plane of FIG. 2 with respect to the first preferred embodiment.

In FIG. 5, there is shown in sectional view a second preferred embodiment of the piston assembly according to the present invention. In this second preferred embodiment, the surface area $S_1$ of the first lubricant reservoir 11*a* is smaller than the surface area $S_2$ of the second lubricant reservoir 11*b*, the depth of the first lubricant reservoir 11*a* is greater than the depth of the second lubricant reservoir 11*b*, and the volume $V_1$ of the first lubricant reservoir 11*a* is greater than the volume $V_2$ of the second lubricant reservoir 11*b*; thus, the ratio of the surface area of the first lubricant reservoir 11*a* to the surface area of the second lubricant reservoir 11*b*, $S_1/S_2$, is all the more definitely less than the ratio of the volume of the first lubricant reservoir 11*a* to the volume of the second lubricant reservoir 11*b*, $V_1/V_2$. Apart from this point, the construction of this second embodiment is quite the same as that of the first preferred embodiment described above.

The effect of this addition feature is that, when the piston goes past its top dead center as explained above, and when the lubricant in the depressions 11*a* and 11*b* is hurled upwards out of them by the action of its inertia and is thrown against the piston crown ceiling surface 3*a* en masse, then since the volume of the first depression 11*a* is greater than that of the second depression 11*b*, therefore more lubricant will be thrown out therefrom, and the collision of these two masses of flung lubricant will result in a net flow away from the opening 18 towards the opening 19, thus again accentuating the above explained cooling lubricant flow pattern. Thereby, the cooling of the piston crown portion 3 is even more effectively accomplished.

Although the present invention has been shown and described with reference to a number of preferred embodiments thereof, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown preferred embodiments, or of the drawings, but solely by the scope of the appended claims, which follow.

What is claimed is:

1. For an internal combustion engine:

a piston assembly, comprising:

(a) a piston main body, comprising a piston crown portion and a generally hollow cylindrical piston wall portion joining thereto which together define a generally cup shaped structure;

and (b) a lubricant reservoir defining member comprising a shelf plate portion and mounted within said cup shaped structure of said piston main body with said shelf plate portion generally parallel to and opposing said piston crown portion, so as to define a chamber space between said piston crown portion and said shelf plate portion;

said shelf plate portion being formed with first and second depressions which define first and second lubricant reservoirs having first and second ends and first and second volumes, respectively, the ratio of the surface area of said first lubricant reservoir to the surface area of said second lubricant reservoir being less than the ratio of the volume of said first lubricant reservoir to the volume of said second lubricant reservoir; said chamber space being supplied with lubricant at a portion thereof adjacent to said first depression and open to drain lubricant therefrom at a portion thereof adjacent to said second depression.

2. A piston assembly according to claim 1, wherein the surface area of said first lubricant reservoir is less than the surface area of said second lubricant reservoir.

3. A piston assembly according to claim 1 or 2, wherein the volume of said first lubricant reservoir is greater than the volume of said second lubricant reservoir.

4. A piston assembly according to claim 1 or 2, wherein said piston crown portion on the side of said shelf plate portion is formed in a shallow concave conical shape.

5. A piston assembly according to claim 4, wherein the point of said shallow concave conical shape of said piston crown portion side opposes said second lubricant reservoir.

6. A piston assembly according to claim 1 or 2, wherein said piston crown portion on the side of said shelf plate portion is formed in a shallow concave spherical shape.

7. A piston assembly according to claim 6, wherein the central point of said shallow concave spherical shape of said piston crown portion side opposes said second lubricant reservoir.

* * * * *

UNITED STATES PATENT AND TRADEMARK OFFICE

CERTIFICATE OF CORRECTION

PATENT NO. : 4,505,233

DATED : March 19, 1985

INVENTOR(S) : M. Kanda, et al.

It is certified that error appears in the above-identified patent and that said Letters Patent is hereby corrected as shown below:

Abstract, line 10, change "generally to" to --generally parallel to--.

Column 1, line 34, change "examle," to --example,--.

Column 4, line 8, change "thereof;" to --thereof,--.

Column 5, line 21, change "that" to --than--.

Column 6, line 34, change "assignee." to --assignee, and having serial no.....--.

Column 8, line 56, change "croown" to --crown--.

Column 10, lines 13-26, change "portion;" to --portion; said shelf--------.

Signed and Sealed this

*Eighth* Day of *October 1985*

[SEAL]

*Attest:*

*Attesting Officer*

DONALD J. QUIGG

*Commissioner of Patents and Trademarks—Designate*